United States Patent [19]

Zuckerman et al.

[11] 4,248,363

[45] Feb. 3, 1981

[54] GARMENT HANGER

[75] Inventors: Jack M. Zuckerman, Forest Hills; John Warmath, Brooklyn, both of N.Y.

[73] Assignee: Cut Rate Plastic Hangers, Inc., Brooklyn, N.Y.

[21] Appl. No.: 33,579

[22] Filed: Apr. 26, 1979

[51] Int. Cl.[3] ..... A47J 51/14

[52] U.S. Cl. ..... 223/91

[58] Field of Search ..... 223/85, 87, 88, 91, 223/92, 93, 95, 96, 97

[56] References Cited

U.S. PATENT DOCUMENTS

| | | | |
|---|---|---|---|
| D. 144,679 | 5/1946 | Bolten | 223/88 X |
| 1,770,159 | 7/1930 | Johnson | 223/88 |
| 2,425,829 | 8/1947 | Rosenberg | 223/88 |
| 2,492,287 | 12/1949 | Hogan | 223/93 |
| 2,622,742 | 12/1952 | Oldham | 223/91 X |
| 3,067,917 | 12/1962 | Reller et al. | 223/91 |
| 3,186,609 | 6/1965 | Patch | 223/88 |
| 3,584,746 | 6/1971 | Marchman | 223/85 X |
| 3,945,543 | 3/1976 | Lazaroff | 223/88 |
| 4,058,222 | 11/1977 | Singer | 223/92 X |

FOREIGN PATENT DOCUMENTS

| | | | |
|---|---|---|---|
| 916481 | 1/1963 | United Kingdom | 223/88 |

*Primary Examiner*—Werner H. Schroeder
*Assistant Examiner*—Andrew M. Falik
*Attorney, Agent, or Firm*—Bauer & Amer

[57] ABSTRACT

An improved garment hanger for supporting a plurality of clothing articles alongside each other such that no one of the garments obscures or otherwise interferes with the display of another by providing the shoulders of the hanger with arms that are spaced from the shoulders and from each other and include means to grip one article of clothing in suspension on the hanger while another article of clothing is supported from the shoulders of the hanger.

2 Claims, 5 Drawing Figures

GARMENT HANGER

BACKGROUND OF THE INVENTION

The present invention relates to garment hangers.

It has become common in the clothing industry for a garment manufacturer to ship his goods to a purchasing retailer with the garments already hung on or otherwise affixed to hangers. The use of so-called ship-on hangers which often remain with the garment even after sale to an ultimate consumer provides many advantages only one of which is minimized handling of the garments by store employees and customers. Reduced handling decreases the probability of soiling, wrinkling or more serious damage to the garment prior to sale.

Multi-piece outfits and certain other varieties of clothing are sometimes sold together as sets or ensembles which might, for example, include a shirt-like top and a pair of slacks or shorts or a skirt. Such an arrangement is quite common in sales of garment sets meant for particularly young children or infants although this practice is by no means so limited. If the various garments comprising the ensemble or set are affixed on the same hanger, it is generally necessary for the customer to remove or otherwise manipulate one of the articles in order to view the other since conventionally known hangers support one of the garments in surrounding or overlying relation to the other. The necessity of removing or manipulating the clothing each time it is viewed by a customer will be understood to substantially increase the possibility of inadvertent soiling or other damage thereto.

As a consequence, the individual garments of an ensemble will often be displayed on separate hangers which, although initially tied or otherwise held together, can become separated from one another whereby the set is broken up. Employee time and labor is then required to identify and reunite the various articles of the separated set and, if the same cannot be located, the individual pieces must be sold separately, often at a loss to the retailer. In addition, the use of multiple hangers increases both hanger cost and the amount of retail rack space required for display of a quantity of garments.

It is, therefore, the desideratum of the present invention to provide a hanger suitable for retaining a plurality of garments such that each of the individual garments is positioned for unrestricted display.

It is a particular object of the invention to provide a unitary garment hanger for simultaneously supporting two garments so that each is clearly visible for inspection without movement or manipulation of the other.

It is another object of the invention to provide a unitary hanger for adjacently supporting two garments alongside each other whereby, when two garments are properly supported, the retention of one of the garments on the hanger prevents the release or removal of the other garment from supported retention thereon.

It is a further object of the present invention to provide a garment hanger for supporting a plurality of garments in position for facilitated and non-manipulated display of each and which is unitarily moldable at low cost utilizing conventional methods and materials.

An improved garment hanger demonstrating objects and advantages of the present invention is comprised, in a preferred embodiment, of a unitary construction molded of a plastic material. The hanger includes a hook and a pair of shoulders outwardly, laterally extending in opposite directions from the hook. An arm extends laterally inward from the outwardly disposed end of each shoulder and carries a garment gripping means on the inwardly disposed end of the arm so that the hanger can support a first garment on its shoulders and a second garment retained by the arm-carried gripping means. The improved hanger of the present invention supports the two garments so that each is adjacently suspended therefrom and can be disposed along substantially parallel planes whereby each garment is unrestrictedly viewable from a respective side of the hanger without the necessity of moving or otherwise manipulating either of the garments. The above brief description, as well as further objects, features and advantages of the present invention, will be more fully appreciated by reference to the following detailed description of a presently preferred, but nonetheless illustrative embodiment in accordance with the present invention when taken in conjunction with the accompanying drawings, wherein:

DETAILED DESCRIPTION OF A PREFERRED EMBODIMENT

The disclosure of the present invention teaches a hanger construction adapted for simultaneously supporting a plurality of garments in such manner that each of the garments is itself individually and unrestrictedly viewable for display purposes without having to move or manipulate the normally supported position of any of the garments. In other words, the hanger normally supports each of the garments so that no one garment is disposed in encircling or otherwise fully obscuring relation with respect to another.

Figure 1:
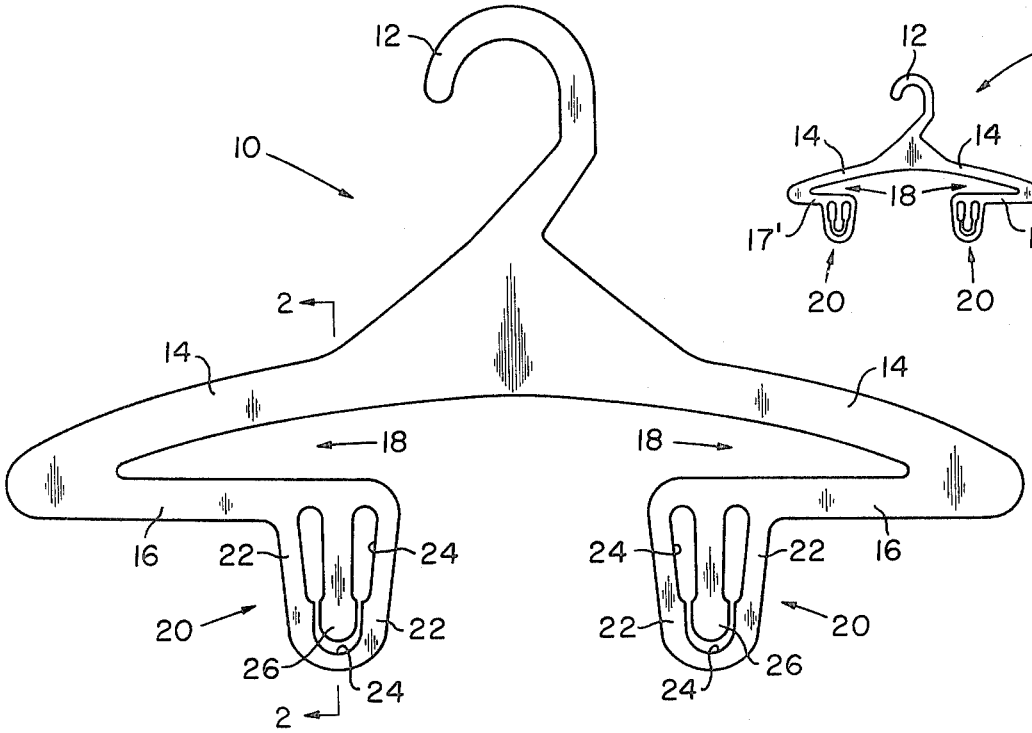
FIG. 1 is a front view of a garment hanger constructed in accordance with the teaching of the present invention.
Figure 2:
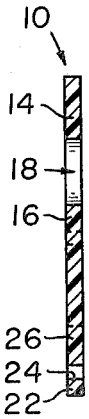
FIG. 2 is a side view of the hanger of FIG. 1 taken along the lines 2—2 thereof.

A preferred but by no means exclusive or limiting embodiment of a hanger constructed in accordance with the present invention is seen in FIG. 1 designated by the general reference numeral 10. The body of the hanger 10 is unitarily molded, for purposes of illustration, so that the same lies fully in and along a single plane although as this description proceeds it will become evident that the planar arrangement of the hanger is not critical to the practice of the concept of the invention. In any event, the side view of FIG. 2 depicts the plane of the hanger 10 and to facilitate an understanding of the invention the hanger plane will be referred to throughout the present description in explaining the suspended relationship of the garments supported on the hanger.

The hanger 10 may conveniently be unitarily molded in a single piece construction of a plastic material and includes a generally hook-shaped element 12 for supporting the hanger from a rod or the like and a pair of sloped or tapered shoulders 14 laterally extending outward from the hook 12 in opposite directions along the hanger plane. The slope of the shoulders 14 preferably substantially conforms to the normal contour of a shouldered garment such as a shirt, blouse, jacket and the like to be hung or otherwise supported therefrom. Those skilled in the art will readily recognize that in the use of conventional hangers a garment supported on the shoulders thereof is suspended from the hanger in substantially planar extension from and along the plane in which the shoulders lie. Likewise, in the absence of the additional structural attributes of the inventive hanger 10 yet to be described a garment hung from the shoulders 14 would normally extend downward along the plane of the oppositely-directed shoulders 14 and hook 12.

However, the hanger 10 of the present invention further includes a pair of arms 16 unitarily joined with the shoulders 14 at or proximate their outermost ends. Each arm 16 extends inwardly along the hanger and may be within or out of the plane from its connection with a respective one of the shoulders 14 so as to define a notch or opening 18 between the arm 16 and the respective unitarily connected shoulder.

A garment gripping means generally designated 20 is carried on the inwardly disposed end of each of the arms 16 and may be integrally formed therewith as by a preferred unitary molding or construction of the hanger 10. The gripping means 20 may comprise any convenient configuration suitable for retaining a garment in a manner to be explained hereinafter. For purposes of illustration, the gripping means 20 is shown in FIG. 1 as a pair of garment retaining clips including a substantially U-shaped member 22 defining a central opening or cut-out 24 and a somewhat flexible and resilient finger 26 extending from its connection with the arm 16 into the central opening 24 so that the finger 26 remains relatively spaced from and within the surrounding U-shaped member 22.

The flexible resilience of the finger 26 which preferably results from a combination of the choice of material of construction of the hanger 10 and the shape or configuration of the finger 26 enables the same to alternately pivot or otherwise flex about its point of connection with the respective arm 16 out of, and then to return to, the plane of the hanger 10 in which the retaining clips 20 and fingers 26 thereof are formed and normally reside. Thus, a piece of material or fabric, as of a garment, inserted between one of the U-shaped members 22 and its respective associated finger 26 causes at least the finger to flex out of its normal plane so that the member 22 and finger 26 are positioned on opposite sides of the interposed fabric.

At the same time, the resilience of the construction material of the hanger 10 effects a directed return urgency of the finger 26 which forces the same toward the plane of the U-shaped member 22 and pressingly against the interposed fabric so as to effectively grip the fabric therebetween and retain the same firmly held within the clip 20. The finger 26 and/or the U-shaped member 22 may be further provided with oppositely directed ridges or the like (not shown) for the purpose of improving the gripped retention of the garment in the clip 20 although it should be understood that the precise configuration of the gripping means 20 and of the individual elements comprising the same are purely a matter of design choice and as such form no part of the present invention.

The inward extension of the arms 16 is such that the gripping means or clips 20 carried on the ends of the arms are positioned in spaced-apart relation with respect to each other. In other words, the amount of inward lateral extension of the arms 16 is insufficient to bring together their inwardly-disposed ends so that a clearance passage or space, which communicates with and provides access to the notches 18, is defined between them and the retaining clips 20. As this description proceeds, it will become clear that the separation between the spaced-apart arms 16 and their retaining clips 20 may advantageously be predetermined to substantially conform to the width or other appropriate measurement of a garment intended to be supported thereby.

Figure 3:
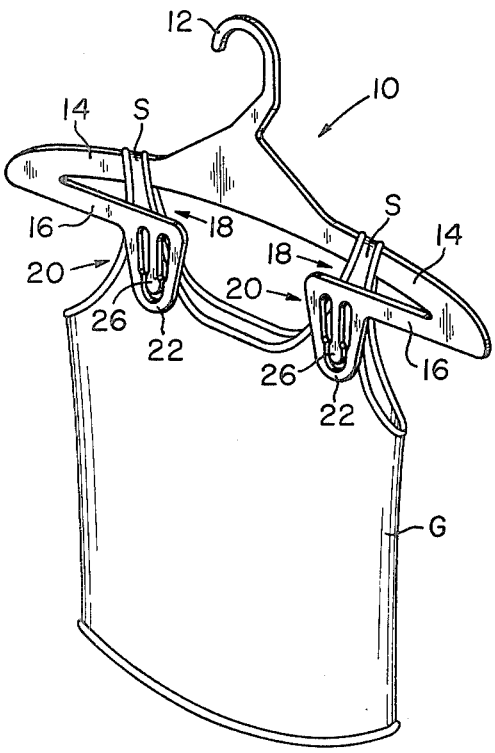
FIG. 3 is a perspective view of the hanger of FIG. 1 supporting a first garment on its shoulders.
Figure 4:
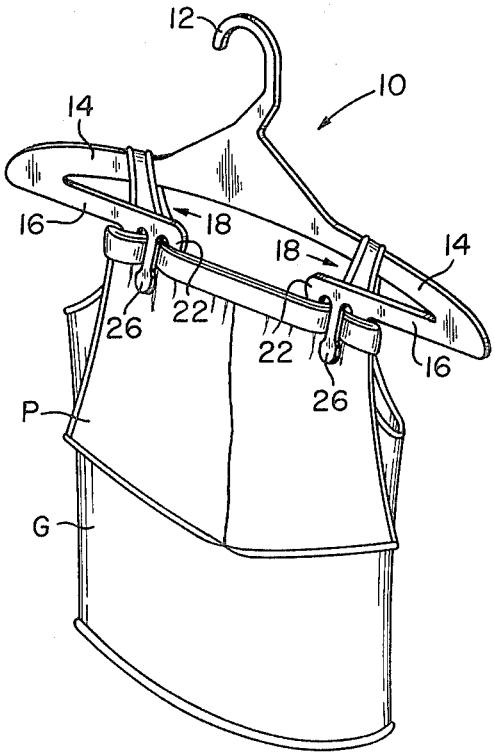
FIG. 4 is a perspective view of the hanger of FIG. 1 supporting two garments suspended therefrom.

Use of the hanger 10 can best be understood with reference to FIGS. 3 and 4 which sequentially depict the manner of supportedly positioning garments thereon. A first garment G, which may for example be a shouldered article such as the strap-supported shirt, or the tank top illustrated, is initially positioned on the hanger 10 in conventionally-known fashion such that each of its straps S are disposed atop and about a respective one of the hanger shoulders 14.

In this initial or starting position (not shown), the garment G is disposed in substantially covering relation about the retaining clips 20 and at least portions of the arms 16 as should be well understood. Put another way, the garment G is hung from the hanger shoulders 14 by its straps S so that the opposite faces of the garment are initially arranged on opposite sides of and covering the remainder of the hanger structure depending from the shoulders 14. Thus, the garment G as so far described can be said to naturally extend in gravitationally-governed suspended relation from the shoulders 14 along the hanger plane and over the lower parts of the hanger.

Were a second garment now to be suspended from the retaining means or clips 20 as intended, this second garment would clearly be obscured and covered from view within the bounded interior of the first garment G which substantially encircles or envelops the clips 20. Accordingly, after initial positioning of the garment G on the hanger shoulders 14 in conventional fashion the suspended or extending portion of the garment G is moved through the notches 18 so that the arms 16 displace the extending garment portion out of the hanger plane in and along which the same would normally be disposed. Movement of the garment's suspended portion is possible because of the clearance passage or space providing by the spaced-apart relation of the arms 16 and their retaining clips 20, which passage communicates with and enables access to the notches 18. In the absence of the opening or spacing between the ends of the arms 16, access of the shoulders-supported garment for insertion through the passage space between the arms 16 and into the notches 18 would not be possible.

Thus, at least one face or side of the shoulders-supported garment G is moved inward along the arms 16, around the retaining clips 20 and through the space between the arms into the communicating notches 18 to the position seen in FIG. 3. As thereshown, the garment G is hung by its straps S from the hanger shoulders 14 and its suspended portion is displaced by the arms 16 to one side of the hanger 10. In this position it is out of and substantially parallel to the plane of the hanger in which the garment G would otherwise lie.

A second garment, which may be a waisted article such as the pants P shown in FIG. 4, is next inserted for retention in the gripping means or clips 20 as previously described. When the retaining clips 20 are themselves disposed in the plane of the hanger 10, the garment P hung from the clips 20 is suspended along the hanger plane and adjacent the garment G displaced therefrom by the arms 16. It will be seen and appreciated that the side-by-side adjacent positioning of the simultaneously supported garments G and P along substantially parallel planes is such that neither garment encircles or obscures the other and enables each to be unrestrictedly displayed.

Specifically, each garment may be viewed, without having to manually move or otherwise manipulate the other, from a respective side of the hanger plane. As a consequence, a consumer may individually examine each article comprising a clothing set or ensemble without actually handling the garments merely by viewing the set from opposite faces of the hanger 10. The retailer may further discourage handling of the clothing by enclosing the hanger 10 and supported garments in a transparent bag or covering (not shown) as of plastic through which the articles can be easily displayed and viewed and thereby substantially insure against soiling or other damage to the garments prior to sale.

Still referring to FIG. 4, it will be further seen that, by reason of the unique structural arrangement of the inventive hanger 10, support of the second garment P in the retaining clips 20 provides the further advantage of preventing release or removal of the first garment G from its supported position on the hanger shoulders 14. The advantage accrues because the retention of a garment in the pair of clips 20 closes or bridges the passage or space between the inwardly disposed ends of the arms 16 against access to or from the notches 18. Since at least portions of the straps S of the garment G must be returned through the passage between the arms 16 in order to remove the garment G from its supported position about the shoulders 14, this closure of the passage or spacing by the garment P prevents such movement. Thus, while the second garment P is held by and between the spaced apart retaining clips 20, the other garment G is essentially captured on the hanger in its shoulders-supported condition.

The hanger 10 is accordingly particularly well suited to ship-on uses or applications, where the hanger accompanies the garments in shipment at least from the manufacturer to the retailer, because so long as the clips 20 provide sufficient retaining action to firmly hold one garment P, the other shoulder-supported article G cannot come free of its supported position on the hanger shoulders 14 irrespective of any amount of jostling or other normally disruptive motion to which the garments may be exposed in the course of shipment.

Those skilled in the art will recognize that the sizing of certain shouldered garments supported on the hanger shoulders 14 or the non-stretchable or otherwise non-deformable character of the material of which the same might prevent or render overly difficult the necessary movement of the garments' suspended portions around the hanger arms 16 and retaining clips 20 for insertion through the notches 18 when the garments are originally positioned, as for shipment, on the hanger 10. This difficulty might, in essence, occur because the amount of inward extension of the arms 16, which may be predetermined or dictated by the width or size of the waisted garment intended to be hung from the retaining clips 20, could in some circumstances be so great to prevent the required movement of the shoulders-supported garment around the hanger arms 16.

Figure 5:
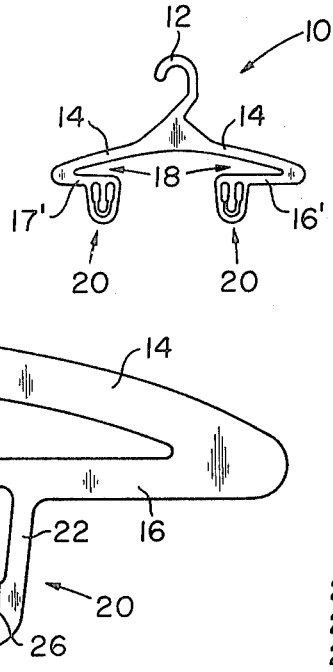
FIG. 5 is a front view of a modification of the inventive hanger of FIG. 1.

Accordingly, there is seen in FIG. 5 a modification of the inventive hanger there designated 10'. The modified hanger 10' is in all respects identical to the embodiment previously described and shown in FIGS. 1-4 with the single exception that the arms labelled 16', 17' are of unequal lengths. In other words, the inward extension along the hanger plane of one of the arms 16' from its unitary connection with a respective one of the shoulders 14 is greater than the corresponding inward extension of the other arm 17'.

In utilizing the hanger 10', the first or shouldered garment is initially moved over the shoulder 14 to which the longer of the arms 16' is connected and, after the portion extending from that shoulder is moved around the arm 16' and retaining clip 20 carried thereby and through the corresponding notch 18, the remaining shoulder of the garment is positioned in the conventional manner atop the other hanger shoulder 14. Because the second of the arms 17' is shorter than the first, there should be no difficulty in moving the portion of the garment extending from the later-positioned garment shoulder around the shorter arm 17' and retaining clip 20 thereon for the purpose of inserting said extending garment portion through the corresponding notch 18. A second garment may then be engaged in the retaining clips 20 as previously described.

There has therefore been described an improved garment hanger suitable for supporting a pair of garments whereby the garments are adjacently held in substantially parallel relation to one another. Neither garment encircles or otherwise obscures the other from view and as a result each garment may be simultaneously and yet individually displayed and viewed without having to manually move, remove or otherwise manipulate either article. In addition, one of the garments is essentially captured against inadvertent release from its supported engagement with the hanger by the retention of the second garment on the hanger.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a garment hanger having means for suspending the hanger and a pair of shoulders connected with and substantially oppositely extending outward from the suspending means, a pair of arms spaced from each other, each arm inwardly extending from and unitarily connected to a respective one of the shoulders and defining a notch between each said arm and the unitarily connected shoulder for receiving therethrough a suspendedly extending portion of a first garment supported on the hanger shoulders so as to facilitate retention of the garment on the hanger, and gripping means carried on each said arm for retaining and suspending a second garment to the hanger such that the two garments are simultaneously supported by the hanger whereby the garments are suspended in side-by-side relation to enable unrestricted individual display of each garment from opposite sides of the hanger, said gripping means comprising a releasable garment-retaining clip carried on the inwardly disposed portion of each of said spaced arms and depending downward therefrom, said clip on one of said arms being spaced apart a predetermined distance from the clip on the other of said arms such that a garment releasably retained by said gripping means is releasably suspended by said clips from said arms and across said space between said clips on each arm, and the inward extension of one of said arms being greater than the inward extension of the other of said arms so as to facilitate the positioning of a garment on the hanger for supported suspension from the hanger shoulders.

2. In a garment hanger according to claim 1, the inwardly disposed ends of said arms carrying said gripping means being spaced apart a predetermined amount from each other so that when a first garment is supported on the hanger shoulders and extended through the space between said arms and said notches and a second garment is suspended from said gripping means on said arms, the second garment closes the space between the inwardly disposed ends of said arms to prevent the release or removal of the first garment from its supported retention on the hanger shoulders while the second garment remains held by said gripping means.

* * * * *